United States Patent [19]

Weiss

[11] Patent Number: 4,573,486

[45] Date of Patent: Mar. 4, 1986

[54] DEVICE FOR CLEANING CONTAINER FILLING MACHINES

[75] Inventor: Wilhelm Weiss, Regensburg, Fed. Rep. of Germany

[73] Assignee: Krones AG Hermann Kronseder Maschinenfabrik, Neutraubling, Fed. Rep. of Germany

[21] Appl. No.: 593,233

[22] Filed: Mar. 26, 1984

[30] Foreign Application Priority Data

Mar. 31, 1983 [DE] Fed. Rep. of Germany ..... 3311800

[51] Int. Cl.[4] ..... B08B 9/00

[52] U.S. Cl. ..... 134/104; 134/136

[58] Field of Search ..... 134/43, 81, 86, 136, 134/146, 150, 104, 121, 166 R; 141/89, 91, 90, 85; 222/148, 149, 151

[56] References Cited

U.S. PATENT DOCUMENTS

| | | | |
|---|---|---|---|
| 3,481,109 | 12/1969 | Pavey | 141/85 X |
| 3,513,024 | 5/1970 | Culliton | 141/91 X |
| 3,522,824 | 8/1970 | Allen et al. | 134/166 R |
| 3,827,466 | 8/1974 | Wiggin | 134/166 R X |
| 3,964,526 | 6/1976 | Sindermann | 222/148 X |
| 4,024,896 | 5/1977 | Ishioka et al. | 141/91 X |
| 4,396,044 | 8/1983 | Ahlers | 141/90 |
| 4,414,036 | 11/1983 | Anderson et al. | 134/166 R |

*Primary Examiner*—Philip R. Coe
*Assistant Examiner*—Frankie L. Stinson
*Attorney, Agent, or Firm*—Fuller, House & Hohenfeldt

[57] ABSTRACT

For cleaning container filling machines through utilization of cleaning-in-place (C.I.P.) canisters that are inserted between rotating filling valves and their matching lift cylinders, the lift cylinders are arrested in their lowest end position by the C.I.P. canisters acting as spacers to allow the cam follower rollers to pass under the stationary lifting cam at a slight distance, while the C.I.P. canisters are held against the filling valve under pressure. The C.I.P. canisters thus remain pressed against the filling valves during the full rotation of the filling machine without the follower rollers being acted on by the lift cam.

5 Claims, 2 Drawing Figures

DEVICE FOR CLEANING CONTAINER FILLING MACHINES

BACKGROUND OF THE INVENTION

This invention relates to apparatus and a method for cleaning of machines that are used for filling containers such as bottles. The term "bottles" will be used herein as a generic term for all types of containers that can be filled with the machine.

A commonly used type of bottle filling machine comprises a stationary floor mounted frame which supports a shaft that is rotatable under power about a vertical axis. A rotor ring is driven by the shaft and is supported on thrust bearings that rest on the frame. A bowl or reservoir for the fluid product that is to be injected into the bottles is mounted to the top of the rotor ring and the bowl is supplied with counterpressure gas. Bottle filler valves are supported radially outwardly from the bowl and are connected to the bowl by means of a gas pipe and a fluid product pipe. A plurality of bottle supports or holders are mounted to the rotor ring through the agency of a pneumatic cylinder on which there is a cam follower which runs onto a single stationary cam at a certain time during rotor rotation to thereby extend the cylinder and lower the bottle holder for having a bottle placed on it. As the cylinder passes the cam, pneumatic pressure drives the bottle on the holder upwardly to engage its mouth with a centering bell which forms a seal so that the fluid product can be inserted in the bottle a moment later. After filling, the bottle holder and the bottle thereon ultimately arrives at the cam again at which time the holder is lowered, the filled bottle is removed and a new empty bottle is placed on the holder and the cycle repeats.

One known method for cleaning machines of this type requires that bottles be placed on the individual bottle platforms or holders for being pressed against the centering bell of the filling valve to thereby provide a liquid tight seal. Prior to this time, the lifting cam for the bottle holders is disengaged to enable the bottles to remain on the platforms or holders throughout full rotation of the rotor ring even in the infeed and discharge regions where the bottle holders or platforms are normally lifted and lowered, respectively.

When all of the bottles are pressed into the centering bells, the cleaning and disinfectant solution is pumped into the valves at high pressure which augments the cleaning process. It would, of course, be possible to substitute recirculating canisters for the standard beverage bottles during the cleaning process. A disadvantage of this method, however, is that it requires periodic removal of the cam which is not easy because the cam must be massively constructed and solidly mounted in order to withstand the high forces that result from the cam followers impacting it.

Another known machine cleaning method involves fastening canisters directly to the filler valve housings concentric to the counterpressure return tubes by means of a special type of releasable clamp or fastener. The containers are then rotated as they are during a normal filling process but they are clear of the lowered bottle holders so there is no interference in the infeed or discharge region. This method, however, does not effect a high sealing pressure between the filling valve and the canister and consequently does not permit circulation of cleaning and disinfecting solution at very high pressure. This known method also requires a canister mounting device on the valve which is not optimally simple in construction nor convenient to use.

The present invention relates to a device, namely, a canister that enables the cleaning operation to be performed without requiring removal or displacement of the cam which, during the normal bottle filling operation, raises and lowers the bottle platforms or holders.

In accordance with the invention, the vertically reciprocable bottle holders are constrained in a lowermost position wherein the cam follower rollers on the lifting cylinders completely clear the cam. Canisters are inserted on the holders and they have greater length than the bottles which the machine is adapted to fill. When the slightly greater length canisters are in place on all of the holders, the lift cylinders are actuated to drive the upper ends of the canisters in sealing relationship with the filler valve. However, the canisters are of such length that the cam follower rollers clear the entire profile of the stationary cam though the rotor can turn if desired. With this arrangement, the canisters can be driven into sealing relationship with the filler valves so that the cleaning solution can be delivered to all fluid conductive parts of the machine at very high pressure which assures good cleaning efficiency.

Since, for functional and safety reasons, the lowest point of the lift cylinders on most common filling machines is generally lower than the lowest point of the lift cam, no special modification of the filling machine is necessary in this case where the canisters have such length as to prevent the cam followers from touching the stationary cam.

The new method has several advantages. One is that the appropriately dimensioned cleaning-in-place (C.I.P.) canisters serve as spacers, thus eliminating the need for any special platform or bottle holding arresting blocks. Another advantage is that the canisters can be inserted effortlessly between the bottle holders and the filling valves after which the holders or platforms are lifted only slightly and pressed against the filling valves with a substantial force. The cleaning solution can then be routed through the valves into the canisters and returned. When the cleaning process is completed, the procedure is reversed where, after release of the pressure, the holders or bottle lifting platforms are returned to their lowest position and the canisters can be easily removed from the filling machine.

A significant advantage of the invention is that it can be applied to existing filling machines without difficulty since it is only necessary to make up canisters that have a somewhat greater length than the bottles which are normally filled in the particular filling machine.

How the foregoing and other objectives, features and advantages of the invention are achieved will be evident in the more detailed description of a preferred embodiment of the invention which will now be set forth in reference to the drawing.

DESCRIPTION OF A PREFERRED EMBODIMENT

Figure 1:
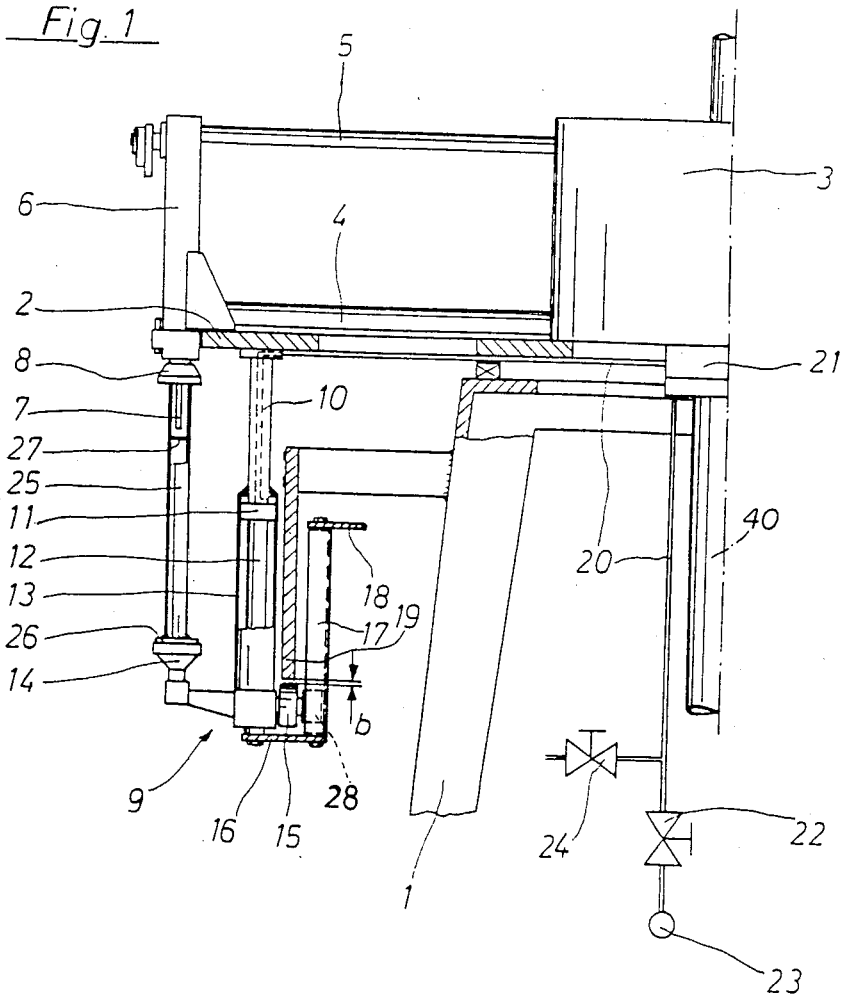
FIG. 1 is a partial side elevation view of a filling machine with some parts appearing in section and other parts being broken away.
Figure 2:
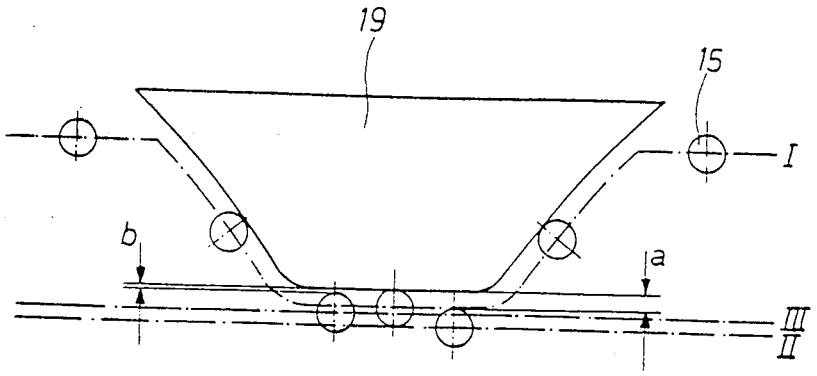
FIG. 2 is a frontal elevation view of the lifting cam 19 which is shown in section in FIG. 1 and which demonstrates the various dwell positions of the cam rollers.

The bottle filling machine shown in FIGS. 1 and 2 comprises a stationary frame 1 that has a shaft 40 journaled for rotation in it. The shaft turns a rotor ring 2 which is supported on thrust bearings that are in turn supported on the frame. A bowl 3 for containing the fluid product and counterpressure gas is mounted to the top of rotor 2. The bowl is connected to filling valves 6 by means of product pipes 4 and gas supply pipes 5. The plurality of filling valves are mounted at the radial extremity of rotor 2 and are circumferentially spaced around the rotor.

Each filling valve 6 has an opening at its bottom for discharge of liquid product, an air return or relief tube 7 and a centering bell 8 that is driven up and down to capture the mouth of a bottle and to seal and stabilize it. In FIG. 1, a canister 25 is taking the place of a bottle and it is assumed that the filling machine is set up for proceeding with the cleaning process.

Associated with each filling valve 6 is a lift cylinder assembly 9 supported from the underside of rotor 2. The lifting assembly 9, in this embodiment, comprises a vertically arranged piston rod 10 that is fastened to rotor 2. A piston 11 is fastened to piston rod 10 and below the piston there is a piston rod extension 12 which extends vertically through the center of the pneumatic piston chamber 13. A bottle supporting platform or holder and a rotatable cam roller or follower 15 is mounted to the cylinder 13 and, hence, to the holder 14. The lower ends of piston rod extensions 12 are all connected to a common floating support ring 16 which rotates with rotor 2 and thereby ties the lift cylinders together for the purpose of stabilizing the lifting units 9.

The lift cylinders 13 are prevented from turning by the use of guide rails 17 that are mounted to floating support ring 16 and the upper ends of guide rails 17 are again stabilized by attaching them to another floating support ring 18. A roller 28 on the same shaft as cam follower roller 15 runs up and down in guide rails 17 but constrains the lift cylinder 13 against rotation. A cam 19 whose profile is shown in FIG. 2, is suspended between guide rail 17 and lift cylinder 13. The cam is rigidly mounted to the center frame 1 and must be made very strong and heavy since it must resist the force of the orbiting cam follower rollers. Each cylinder 13 is supplied with air pressure by way of a duct, shown in dashed lines, extending down the center of piston rod 10 and terminating in the space above the piston in the vertically movable cylinder 13. This air is suoplied from a compressed air source 23 by way of a tube 20 leading from a rotary manifold 21. There is a pressure regulating valve 22 in tube or line 20.

During the normal bottle filling procedure, when there are bottles on the platforms or holders 14 instead of the canister 25, and the product stored in bowl 3 is being delivered under the counterpressure method, valve 22 is fully open and provides compressed air to all lift cylinders 13. The air pressure always tries to drive the lift cylinders 13 to their uppermost limit and this is the case except when the cylinders 13 are in some intermediate vertical elevation because of being in contact with the profile of cam 19. As previously mentioned, in the bottle infeed and discharge region of the filling machine, the lift cylinders 13 are moved downwardly by cam 19 and remain briefly in this lower position until the filled bottle is removed and an empty bottle is placed on the bottle platform 14. As the followers proceed along the cam, air pressure then causes the platform or bottle holder at the end of cam 19 to turn to its upper position, thereby pressing the mouth or opening of the bottle into the centering bell to effect a seal after which the filling valve 6 is opened at the proper time and the bottle is filled. The various vertical positions that the cam follower rollers 15 assume as they follow along the profile of cam 19 during the normal bottle filling operation are shown along a line designated I in FIG. 2.

The cleaning process and the apparatus that is used during cleaning, in accordance with the invention, will now be described in greater detail. First of all, lift cylinders 13 are purged of pressurized air by closing valve 22 and opening relief valve 24 to vent the air to the atmosphere. This causes all lift cylinders 13 to drop to their lowest position under the influence of gravity that acts on the combined mass of the cylinders, the holders, the cam followers, the floating rings and the guide tracks. Ring 16 provides a uniform stop for all of the pneumatic lifting assemblies 9.

The next step is to place the special C.I.P. containers or canisters 25 on each bottle platform or holder 14. The canisters are basically pipes that can be slipped over the air return tubes 7 in the centering bells 8 after which their lower ends are dropped into the platforms 14. More specifically, the canisters 25 have a base plate 26 closing the lower end of the pipe. The base plate 26 is welded to the lower end of the pipe. Near the upper end, there is a separating plate 27 sealed in the pipe which provides a chamber above it that is open to the top of the pipe for entry of the cleaning solution. This pressure chamber is considerably shorter than the total height of the C.I.P. canister or container 25 and is dimensioned to surround the filling tube 7 with proper clearance. The opening of canister 25 corresponds in both size and shape to the containers, such as bottles, that are ordinarily filled on the machine and consequently provides a liquid tight seal with the centering bell 8 and the product tube of the filling valve 6. The canisters are dimensioned to facilitate easy insertion in the centering bells 8 which contains the filling tube and they are placed concentric with the air return tubes 7 after which their lower ends are swung onto the bottle platforms 14.

During placement of the canisters 25, the lift cylinders 13 remain in their lowest limiting position whereupon the cam followers 15 are in position II of the motion path shown in FIG. 2. In other words, the cam follower rollers 15, at this time, clear the profile of cam 19 by the maximum amount. In an actual embodiment, the cam followers 15 and cam 19 are separated by approximately 30 mm at this time. When all canisters 25 are in place, pressure release valve 24 is closed and pressure supply valve 22 is opened to provide all lift cylinders with compressed air in the space above their pistons 11. The lift cylinders 13 now move slightly upward, pressing the canisters 25 against the filling valve 6 and developing a tight liquid seal in the centering bell 8. At this time, further upward travel of the lift cylinders is prevented by the properly dimensioned canisters which are acting as spacers. The lift cylinders and, particularly, the cam follower rollers 15 thus remain in their lower position with several mm of clearance between the cam follower rollers and the cam 19. The cam follower rollers 15 are, at this time, disposed along the line III in FIG. 2 and there is still a clearance of the dimension b between the cam and follower rollers as indicated in FIG. 2.

Assuming now that the fill product and counterpressure gas has been removed from bowl 3, the bowl can now be filled with cleaning and disinfecting solution and highly pressurized after which rotor 2 is set in rotational motion. The cam follower rollers 15 thus move along the motion path at the elevation III without making contact with any part of the stationary cam 19. The elevation of the platforms or bottle holders 14 remains constant throughout rotation of rotor 2 as does the sealing pressure between valve 6 and the canister 25.

During rotation of the valve 6, the cleaning solution is recirculated through canisters 25 and provides thorough cleaning of all valve bores and passages.

At the conclusion of the cleaning process, the cylinders 13 are purged of air by way of closing supply valve 22 and opening valve 24 which causes the cylinders 13 to return to their lowest position at which there is the greatest clearance between the cam follower rollers and the cam. The canisters 25 located between valve 6 and the platforms or bottle holders 14 are then removed. After drainage of the cleaning solution and closing of valve 24 and opening of compressed air supply valve 22, all lift cylinders will be forced upwardly again to an elevation wherein the cam follower rollers 15 will again be in contact with and actuated by stationary cam 19. The normal bottle filling process can then be resumed.

It will be appreciated by those skilled in the art that the machine described herein as a bottle filling machine can be adapted to the filling of other containers such as cans in which case it would only be necessary to modify the canisters in respect to length and configuration at their upper ends for effecting a seal during cleaning.

I claim:

1. A device for facilitating cleaning of container filling machines of the type which for filling purposes comprise a rotor rotatable about a vertical axis, a plurality of filler valves mounted to the rotor for revolving about said axis, an extensible and contractible lifting and lowering cylinder adjacent each filler valve and revolving therewith, said cylinder being continuously pressurized to exert a lifting force, a container support platform and a cam follower element mounted to each cylinder for moving in a circular path about said axis, a stationary cam in the path of the followers and profiled such that when engaged by a follower there is a sequential lowering of a platform to one lower level in opposition to said lifting force for displacement of a container on the platform and raising of said platform by said lifting force to couple said container with the filling valve, said device for facilitating cleaning comprising a canister means having a length dimension great enough so that when said pressure is releived from said cylinder and there is a lowering of said followers to a lowermost position clear of said cam and said platform lower correspondingly to below said one lower position, said canister means will fit between said platform and filler valve, and when said cylinder pressure is restored said canister means will be coupled tightly with said filler but will still constrain said followers to remain clear of said cam so that cleaning fluid can be discharged from the filler valve to the canister while the rotor is rotating.

2. The apparatus according to claim 1 wherein said length dimension of said canister is greater than the height of the containers which the filling machine is adapted to fill.

3. The apparatus according to any of claims 1 or 2 wherein said canister means is comprised of a pipe member having a base plate at one end for resting on the platform and a separator wall disposed interiorly thereof axially spaced from its other end to thereby define a pressure chamber for cleaning fluid when said other end is coupled to a filler valve.

4. The apparatus according to claim 3 wherein the total length of said pipe member is more than twice the axial depth of said chamber.

5. A canister means adapted to substitute for a bottle in a bottle filling machine during circulation of cleaning fluid through the machine, said machine including filler valves and platform means aligned therewith, means for exerting a continuous upward force on said platform and means for periodically reciprocating said platform means vertically to raise a bottle and lower the bottle to a first lower limit to correspondingly couple and uncouple the bottle and said filler, said reciprocating means being operative when said platform is free to move between lower and upper limits, said canister means comprising a pipe element having an axial length greater than the height of said bottle for being interposed between said platform and filler valve when said force is temporarily removed so that said platform means is at a second lower limit and lower than said first lower limit, restoration of said force causing said canister on the platform to couple in pressure relation with said filler valve and said platform to move to a position between said second and first lower limits at which position said reciprocating means becomes disabled.

* * * * *

UNITED STATES PATENT AND TRADEMARK OFFICE

CERTIFICATE OF CORRECTION

PATENT NO. : 4,573,486

DATED : March 4, 1986

INVENTOR(S) : Wilhelm Weiss

It is certified that error appears in the above—identified patent and that said Letters Patent is hereby corrected as shown below:

Column 5, line 49, change "displacement"
to read --replacement--

Column 6, line 3, change "releived"
to read --relieved--

Signed and Sealed this

Fourteenth Day of April, 1987

*Attest:*

DONALD J. QUIGG

*Attesting Officer*

*Commissioner of Patents and Trademarks*